United States Patent [19]

Colby

[11] 4,112,855

[45] Sep. 12, 1978

[54] FOLDABLE FURNITURE UNIT

[75] Inventor: Donald B. Colby, Los Angeles, Calif.

[73] Assignee: Scott Paper Company, Philadelphia, Pa.

[21] Appl. No.: 837,894

[22] Filed: Sep. 29, 1977

[51] Int. Cl.[2] ..... A47B 3/06

[52] U.S. Cl. ..... 108/159; 108/115; 108/124; 248/188.6

[58] Field of Search ..... 108/157, 159, 153, 111, 108/115, 124, 129, 160, 121; 312/258; 248/165, 150, 166, 439, 188.6

[56] References Cited

U.S. PATENT DOCUMENTS

| | | | |
|---|---|---|---|
| 1,432,959 | 10/1922 | Brady | 108/157 |
| 2,057,334 | 10/1936 | Hannum | 108/157 |
| 2,613,957 | 10/1952 | Ritter | 108/153 X |
| 2,857,227 | 10/1958 | Jacques | 108/124 |
| 3,108,550 | 10/1963 | Knoblock | 108/124 |
| 3,128,727 | 4/1964 | Rainwater | 108/153 |
| 3,401,653 | 9/1968 | Knoblock | 108/124 |
| 3,458,242 | 7/1969 | Williams | 312/258 |
| 3,561,376 | 2/1971 | Knoblock | 108/124 |

*Primary Examiner*—James T. McCall

*Attorney, Agent, or Firm*—Martin L. Faigus; William J. Foley

[57] ABSTRACT

A foldable furniture unit includes a foldable base framework provided by a plurality of generally U-shaped support members; each including a horizontal cross-piece joined at opposite ends to vertically disposed leg sections. Each leg section of each support member is adjacent to and substantially vertically aligned with a leg section of a different support member to provide a plurality of spaced-apart, double-leg section supports; and connectors rotatably join together the double-leg sections of each of the supports. Preferably, the foldable base framework is employed in a table having a top that is removably connected through retainers to horizontal cross-pieces of more than one U-shaped support member.

6 Claims, 5 Drawing Figures

FOLDABLE FURNITURE UNIT

BACKGROUND OF THE INVENTION

This invention relates generally to a foldable furniture unit, and more specifically, to tables employing a foldable base framework.

Even though folding furniture units have been made with many different types of folding frame members, a need for improvement still is perceived to exist; particularly in the construction of folding tables that might be used to support relatively heavy loads (e.g. dining tables, card tables, coffee tables, side tables, etc.). it is desirable to construct these tables so that they are extremely rigid and sturdy, and also so that they have a high quality appearance generally associated with non-folding furniture units. When people are to be seated at the table, it also is desirable to provide ample leg room about substantially the entire perimeter of the table top.

U.S. Pat. Nos. 3,108,550; 3,401,653 and 3,561,376, issued to Knoblock, are all of a similar construction, and appear, at first glance, to disclose frame members similar to the foldable base framework of the instant invention. However, there are significant differences between the construction of the instant invention, and the construction suggested by Knoblock. Moreover, as a result of these differences, the foldable base framework of the present invention is much better suited than the Knoblock frame members for use in rigid furniture units, such as in dining tables.

In the Knoblock units the sides of the tabletop are supported in a cantilever fashion on legs U-shaped side supports. This type of cantilever mounting may be suitable for use in small table constructions. However, where greater rigidity is desired, such as in larger dining tables, this cantilever arrangement may not provide the necessary support for the tabletop. Moreover, in the Knoblock constructions the horizontal bottom legs make it quite difficult for individuals to sit at the sides of the table. This undesirably limits the area about the table that is usable to accommodate individuals.

It is common practice in folding furniture designs to improve the rigidity of folding frame members by bracing them with pivotable links or other rigidifying members. However, these bracing members increase the complexity and cost of the folding mechanisms, and, when used in tables, often take up desired leg area.

SUMMARY OF THE INVENTION

A foldable furniture unit of this invention includes a foldable base framework provided by a plurality of generally U-shaped support members, each of which has a horizontal cross-piece joined at opposite ends to vertically disposed leg sections. The support members are positioned adjacent to each other so that each leg section of each support member is adjacent to and substantially vertically aligned with a leg section of an adjacent support member to provide a plurality of spaced-apart double-leg section supports. Connectors are provided for rotatably joining together the double-leg sections of each of these supports.

In the preferred arrangement of this invention the foldable base framework is employed in a table construction having a removable tabletop. The top is positioned in overlying relationship with the horizontal cross-pieces of the support members and is removably connected to more than one of these cross-pieces through retaining members. By supporting the tabletop on the cross-pieces, and not in a cantilever fashion on the legs of the U-shaped members, an extremely rigid arrangement is established. This is in distinction to the cantilever mounting employed in the earlier-referred-to Knoblock constructions.

The present invention also has the advantage of establishing rigidity without the use of braces or other supports that can take up valuable leg room, detract from desired aesthetic qualities and increase material costs. In fact, foldable tables of this invention have the general appearance of high quality, non-folding furniture units.

It is an object of this invention to provide a folding furniture unit that is of a rigid construction.

It is a further object of this invention to provide a folding furniture unit having the general appearance of a non-folding furniture unit.

It is a further object of this invention to provide a folding table that is extremely rigid, and that has ample leg room to accommodate individuals about substantially the entire perimeter of the tabletop.

Other objects and advantages of this invention will become apparent by referring to the detailed description which follows, taken in conjunction with the drawings.

DESCRIPTION OF THE PREFERRED EMBODIMENT OF THE INVENTION

Figure 1:
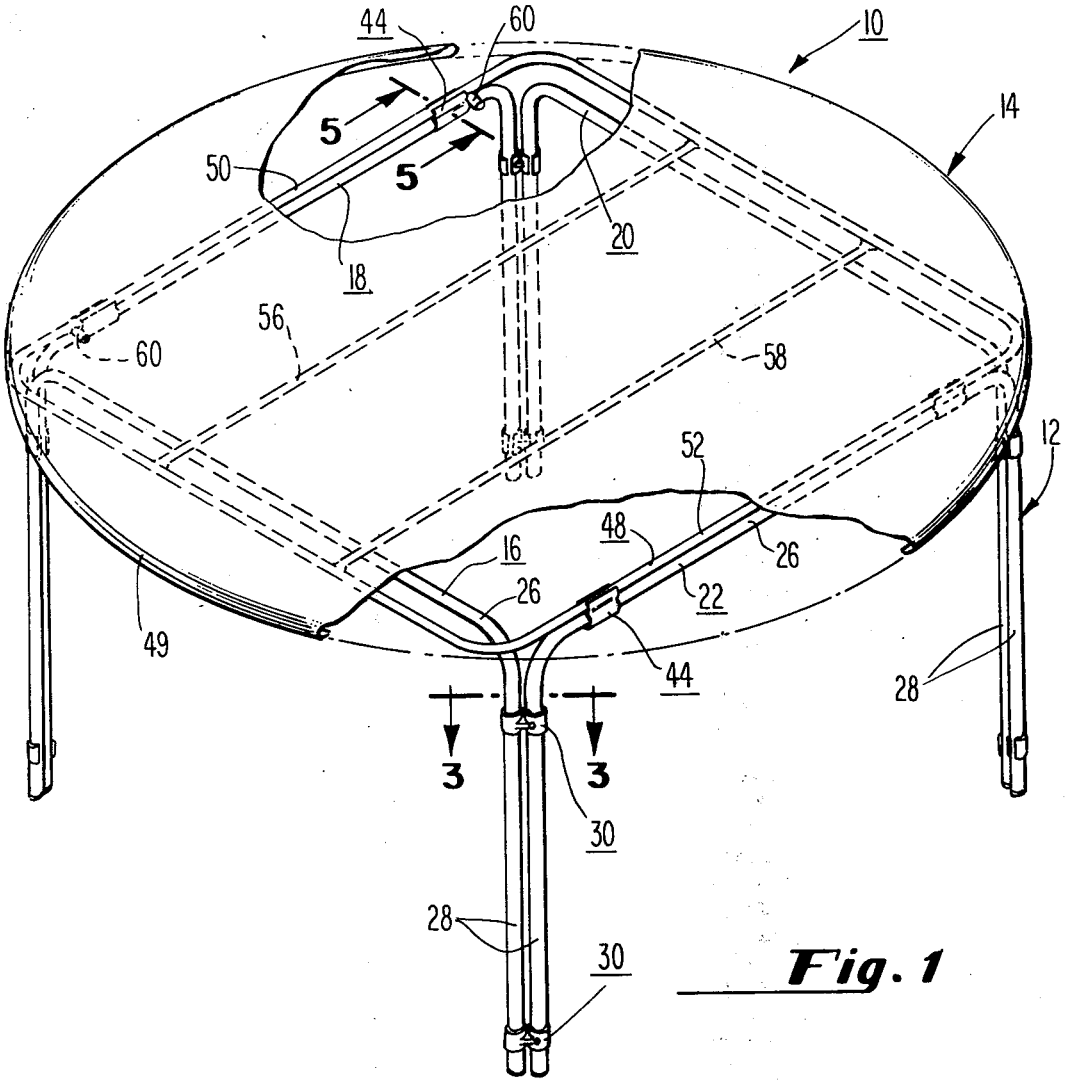
FIG. 1 is an isometric view of a folding table in accordance with this invention, with parts broken away to show details of construction.
Figure 3:
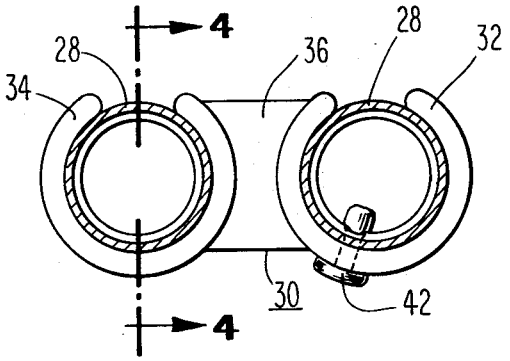
FIG. 3 is a sectional view taken along line 3—3 of FIG. 1.
Figure 4:
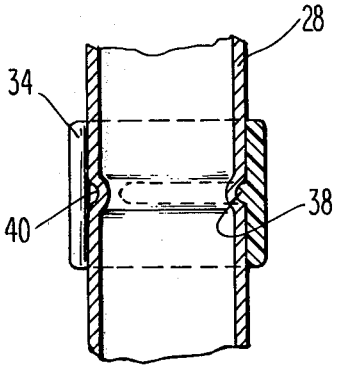
FIG. 4 is a sectional view taken along line 4—4 of FIG. 3.
Figure 2:
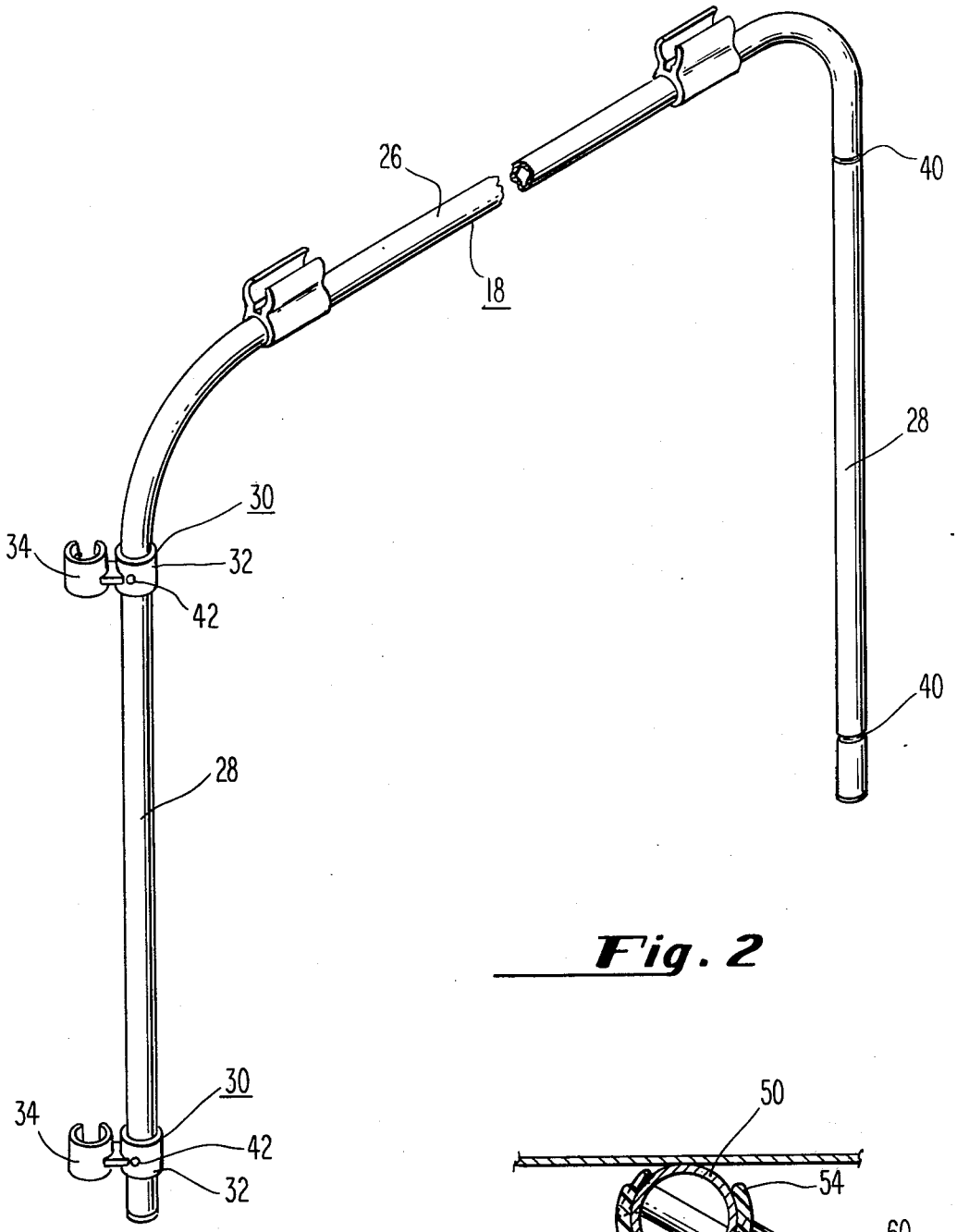
FIG. 2 is an isometric view of a support member employed in the foldable base framework of this invention.

Referring to FIG. 1, a folding table 10 in accordance with this invention includes a base framework 12 that is foldable, and a top 14 removably connected to the framework. The base framework 12 includes four inverted U-shaped members 16, 18, 20 and 22; each including a horizontal cross-piece 26 and downwardly directed vertical leg sections 28 (FIGS. 1 and 2). As can be seen best in FIG. 1, the four U-shaped members are positioned in a closed, generally rectangular arrangement with the leg sections of each member being adjacent to a leg section of another member. In this manner, four double-leg section supports are provided.

Referring to FIGS. 1—4, a plurality of double-leg section connectors 30 are provided to connect adjacent leg sections of the U-shaped members together. These connectors 30 preferably are molded from a flexible plastic material, such as a glass-filled polyurethane, and include spaced-apart C-shaped clip sections 32 and 34 joined together through a central web section 36. The interior of each clip section is provided with an inwardly directed rib 38 (FIG. 4) that is snapped into engagement with a groove 40 that is rolled into the leg section 28. Preferably the grooves 40 are formed in each leg section in at least two spaced-apart areas; one near the bottom, and the other near the top; and two connectors 30 are provided to connect together each pair of adjacent leg sections at these grooves. As can be seen most easily in FIGS. 2 and 3, one clip section 32 of each connector 30 is fixed against rotation to a leg section 28 by a suitable retaining means, such as a rivet 42. The other clip section 34 is rotatably joined to the leg to which it is connected by the cooperation of its rib 38 with a groove 40. The provision of four double-leg section supports, as disclosed herein, provides an extremely rigid construction for the folding articles of this invention.

Figure 5:
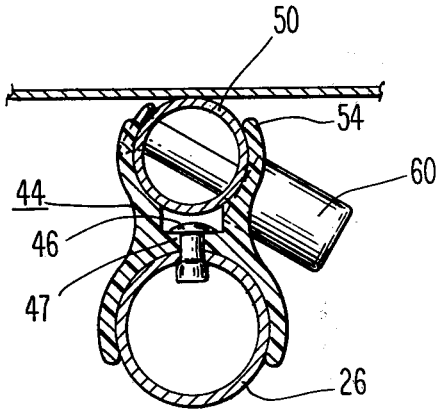
FIG. 5 is a sectional view taken along line 5—5 of FIG. 1.

Referring to FIGS. 1 and 5, tabletop retainers 44 are extruded from a suitable plastic material, such as an ABS resin, and are attached, in a spaced-apart relationship to each other, to cross-pieces 26 of the opposed base members 18 and 22. Each retainer 44 is connected to its respective cross-piece 26 by a rivet 46 extending through a central web section 47 of the retainer (FIG. 5).

Referring to FIG. 1, the tabletop 14 is shown as being circular; however, other configurations can be employed. This top is strengthened by a rectangular metal frame 48 that is welded to an outer peripheral rim 49 of the top. Besides strengthening the top, the frame 48 includes horizontally disposed cross members 50 and 52 that can be snapped into upper clip sections 54 of the tabletop retainers 44 (FIG. 5) to provide the removable attachment between the tabletop 14 and the base framework 12. In the embodiment shown for illustration the strengthening frame 48 also includes strengthening members 56 and 58 to provide additional suppot for the center of the tabletop 14.

Referring to FIGS. 1 and 5, a pair of spaced-apart pins 60 are connected to each of the horizontal cross members 50 and 52 of the frame 48 for use in properly centering the top 14 on the base framework 12. These pins 60 are riveted to the cross members 50 and 52, and project in a radial direction to overlie and cooperate with an adjacent tabletop retainer 44, as can be seen most clearly in FIG. 5. The pins 60 are spaced to straddle the spaced-apart retainers 44 when the tabletop is properly centered. Once the tabletop is properly connected to the base framework 12 it will be prevented from excessive lateral shifting by the interference established between the pins 60 and the retainers 44.

The table of this invention can be easily stored by removing the top 14 from the base framework 12, and then folding the framework into compact condition. If desired, the various U-shaped members 16, 18, 20 and 22 can be disconnected from each other by snapping the rotatable legs out of their respective clip sections 34. FIG. 2 shows the U-shaped member 18 separated from the other base members.

If desired, the base framework 12 can be shipped as four separate U-shaped members, or as two separate sections. This is accomplished by snapping clip sections 34 of the connectors 30 off of the rotatably joined legs—either at all four corners or at only two corners.

The tables of this invention can be formed in many different heights, and therefore, can be used for many different purposes. For example, they can be used as dining tables, side tables, coffee tables, etc. In addition, the U-shaped members can be varied in width so that the double-leg section supports are either near the outside of the top 14, or set in closer to the center to provide a pedestal-type appearance. However, in each case, an extremely sturdy folding table with ample leg room can be provided.

I claim:

1. A folding table including a tabletop that is removably connected to, and completely separable from a foldable base framework; the improvement wherein the framework includes a plurality of support members, each support member having a horizontal cross-piece joined at opposite ends to vertically dispose leg sections, each leg section of each support member being adjacent to and substantially vertically aligned with a leg section of a different support member to provide a plurality of double-leg section supports, each double-leg section support being horizontally spaced from an adjacent double-leg section support by the horizontal cross-piece of a support member to provide ample leg room for accommodating individuals about substantially the entire perimeter of the tabletop, tabletop retaining means for removable connecting the tabletop to cross-pieces of more than one support member and connecting means including space-apart leg-engaging sections for rotatably joining together, in a spaced-apart relationship, the two leg sections forming each double-leg section support, one leg-engaging section of the connecting means being fixed against rotation to one of the two leg sections of the double-leg section supports, and the other leg-engaging section of the connecting means being rotatably joined through interengaging surfaces to the other leg section of the double-leg section supports, whereby the other leg sections of the double-leg section supports constitute the axes of rotation about which the support members can be rotated into a collapsed condition when the tabletop is removed from the framework, and interengaging surfaces also aiding in establishing and maintaining the desired relationship between the support members.

2. The folding table of claim 1 including four of said support members forming four of the double-leg section supports.

3. The folding table of claim 2 wherein the interengaging surfaces are provided by a rib on said other leg-engaging section of each connecting means and a mating groove in each of said other leg sections.

4. The folding table of claim 2 wherein said connecting means are secured to each double-leg section support in at least two vertically spaced-apart locations.

5. The folding table of claim 2 wherein the tabletop retaining means connect the tabletop to cross-pieces of less than all of the support members.

6. The folding table of claim 5 wherein the tabletop retaining means only connect the tabletop to cross-pieces of alternate support members.

* * * * *